United States Patent [19]

Van Daelen

[11] Patent Number: 4,479,073

[45] Date of Patent: Oct. 23, 1984

[54] CATHODE RAY TUBE WITH LAMINAR CATHODE SUPPORT

[75] Inventor: Henri J. G. M. Van Daelen, Eindhoven, Netherlands

[73] Assignee: U.S. Philips Corporation, New York, N.Y.

[21] Appl. No.: 294,970

[22] Filed: Aug. 21, 1981

[30] Foreign Application Priority Data

Sep. 19, 1980 [NL] Netherlands ..... 8005230

[51] Int. Cl.[3] ..... H01J 29/46; H01J 9/18

[52] U.S. Cl. ..... 313/451; 313/270; 445/34

[58] Field of Search ..... 313/444, 446, 447, 448, 313/449, 451, 257, 270; 445/34, 36

[56] References Cited

U.S. PATENT DOCUMENTS 2,883,576 4/1959 Harries ..... 313/257

*Primary Examiner*—Palmer Demeo
*Assistant Examiner*—Sandra L. O'Shea
*Attorney, Agent, or Firm*—Robert J. Kraus

[57] ABSTRACT

A cathode support, in an electron gun of a cathode ray tube comprising four lamellae (22, 24, 25, 30) which are connected together by means of an electrically insulating sealing glass (23). A first one of the lamella (22) engages a first electrode (10) of the electron gun. Second and third lamellae (24, 25) are situated substantially in one plane, are electrically-insulated from each other, and are cathode filament. The cathode shaft (33) is suspended from a fourth one of the lamellae (30). The cathode support is well suited for automated mass production.

6 Claims, 7 Drawing Figures

CATHODE RAY TUBE WITH LAMINAR CATHODE SUPPORT

BACKGROUND OF THE INVENTION

The invention relates to a cathode ray tube comprising an evacuated glass envelope containing an electron gun to generate an electron beam for scanning a target. The electron gun includes a first electrode and of a cathode unit comprising a cathode support to which a cathode shaft having a cathode filament is connected. The cathode support is secured to the first electrode.

Such cathode ray tubes may be, for example, television camera tubes, television picture display tubes, or oscilloscope tubes. In a television camera tube the target usually is a photosensitive layer on a signal electrode. In a display tube the target is a display screen comprising one or more phosphors which are provided, for example, in a pattern of lines on the inside of the display window of the envelope.

Such a cathode ray tube, in the form of a television camera tube, is disclosed in Netherlands Patent Application No. 7807757 corresponding to U.S. Pat. No. 4,309,638. The cathode in the television camera tube described in this Patent Application is connected in a cathode supporting bush by means of a disc of insulation material. This cathode supporting bush is connected with its end face against a part of a first electrode, a sleeve-like anode, extending perpendicularly to the axis of the tube, which part of the anode in turn is placed against a surface part of the inner wall of the envelope extending perpendicularly to the axis of the envelope. Before they are connected, the anode and the cathode supporting bush are movable radially with respect to each other and are hence adjustable. The disadvantage of such a construction is that when such a sleeve-like anode is used the diameter of the envelope must increase stepwise in two directions. This presents probelms in manufacturing the envelope. Moreover, the construction of the cathode support is complicated and not suitable for mass production.

SUMMARY OF THE INVENTION

It is therefore an object of the invention to provide a cathode ray tube having a simple cathode support construction which is suitable for mass production and which can be used in an envelope having an inside diameter which increases stepwise only in one direction.

Another object of the invention is to provide a cathode ray tube which is shorter than comparable known cathode ray tubes.

According to the invention, a cathode ray tube of the kind mentioned in the opening paragraph is characterized in that the cathode support comprises four metal lamellae to which the electric connections are made and which are secured together by means of an electrically insulating sealing glass. The first lamella engages the first electrode. The second and third lamellae are situated substantially in one plane and are electrically-insulated from each other, and are electrically-connected to the cathode filament. The cathode shaft is suspended from the fourth lamella.

In a first preferred embodiment of a cathode ray tube in accordance with the invention, at least two strips extend from the fourth lamella substantially parallel to the axis of the envelope, which strips are secured to a metal intermediate plate extending parallel to the lamella. This plate supports the cathode shaft by means of metal bands or wires. It is also possible to connect the cathode shaft directly to the fourth lamella by means of bands or wires.

In a second preferred embodiment of a cathode ray tube in accordance with the invention, the metal intermediate plate has two apertures in which metal rods are secured by means of a sealing glass, substantially parallel to the axis of the envelope in an electrically insulated manner. Metal vanes are welded to the rods on one side of the intermediate plate. The cathode filament is connected to the vanes. On the other side of the intermediate plate the rods make electrical contact with contact springs extending from the second and third lamellae.

In a third preferred embodiment of a cathode ray tube in accordance with the invention, the imtermediate plate has a central aperture in which a cylindrical heat reflection screen is provided which coaxially surrounds the cathode shaft.

The lamellae preferably form one assembly with the connection strips which are passed through the wall of the cylindrical envelope and serve as means for making electrical connections to the anode, the cathode and the cathode filament.

Such a construction has proved very suitable for automated mass production. Moreover, the use of a tube base for assembling the electron gun is not necessary and tubes with side contacts are obtained. As a result of this the length of the tubes is minimized.

In a preferred method of manufacturing a cathode support for a cathode ray tube according to the invention, a large number of the first lamellae are juxtaposed and interconnected to form a first band; a large number of the second and third lamellae are juxtaposed and interconnected to form a second band; and a large number of fourth lamellae are juxtaposed and interconnected to form a third band. These three bands are provided with reference holes with which the lamellae in the three bands are positioned relative to each other. Rings or parts of rings of a sealing glass are then provided between adjacent lamellae, after which the assembly thus formed is heated to the melting temperature of the sealing glass, and the lamellae are secured together. Finally the cathode supports are obtained by bending the strips, contact springs and possibly other parts of the lamellae, and cutting the assembled lamallae loose from their respective bands. The three bands are preferably positioned relative to each other in a jig.

BRIEF DESCRIPTION OF THE DRAWING

Embodiments of the invention will now be described in greater detail, by way of example, with reference to a drawing, in which.

DESCRIPTION OF THE PREFERRED EMBODIMENTS

Figure 1:
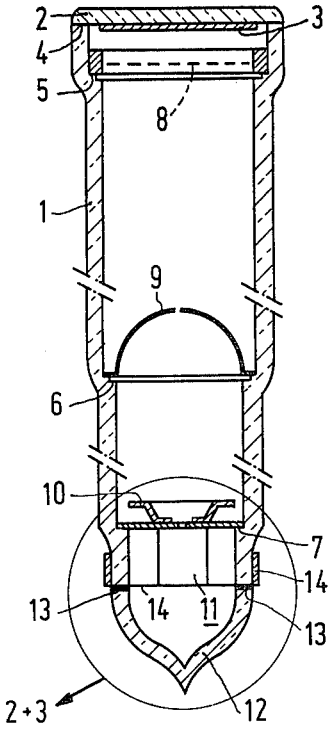
FIG. 1 is a longitudinal sectional view of a cathode ray tube according to the invention.

FIG. 1 is a longitudinal sectional view of a television camera tube according to the invention. This tube comprises a cylindrical glass envelope 1 which has a stepped construction which has been obtained by forming on a stepped mandril a glass tube which has been softened by heating. At one end the tube is sealed by a window 2 on the inside of which the photosensitive target 3 is provided. The window 2 bears on the edge 4 which is parallel to the step surfaces 5, 6 and 7 against which are placed a gauze electrode 8, a diaphragm 9 and an anode 10, respectively. In this manner the components are positioned accurately with respect to each other. Wall electrodes, which are not shown in this figure are provided in the usual manner on the inner wall of the cylindrical envelope. A cathode support 11 is secured to a first electrode, the anode 10. The glass envelope 1, at the end opposite the window, is sealed by means of a cap 12 which is secured to the envelope by means of a sealing glass 13. Connection strips 14 extend from the cathode support 11 pass through the sealing glass seam, and serve as means for making electrical connections to the anode, the cathode and the cathode filament. The photosensitive target 3 usually consists of a photoconductive layer which is provided on a transparent signal plate. The operation of such a tube is as follows. A potential distribution is formed on the target 3 by projecting an optical image onto it. This potential distribution is formed because the photoconductive layer of the target may be considered to be composed of a large number of picture elements. Each picture element may be considered to be a capacitor to which a current source is connected in parallel, the current being substantially proportional to the light intensity on the picture element. The charge on each capacitor decreases linearly with time if the light intensity is constant. The scanning electron beam originating from the electron gun periodically passes each picture element and recharges the respective capacitor. Consequently, the voltage across each picture element is periodically brought to the potential of the cathode. The quantity of charge which is periodically needed to charge each capacitor is proportional to the light intensity on the respective picture element. The associated charge current flows via a signal resistor to a signal plate which is situated below the photoconductive layer on the window and which all picture elements have in common. A voltage variation, developed across the signal resistor as a function of time, represents the light intensity of the optical image as a function of the position of the beam on the target. A television camera tube operating as described is termed a vidicon. It will be obvious that the construction according to the invention may also be used in other types of television camera tubes and cathode ray tubes.

Figure 3:
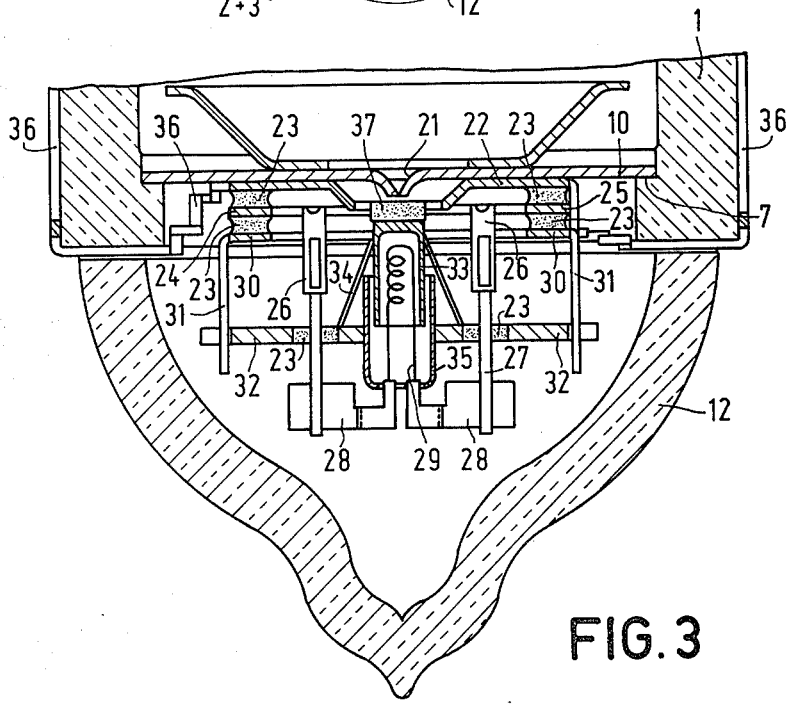
FIG. 3 is a sectional view of a part of the cathode ray tube in FIG. 1.
Figure 2:
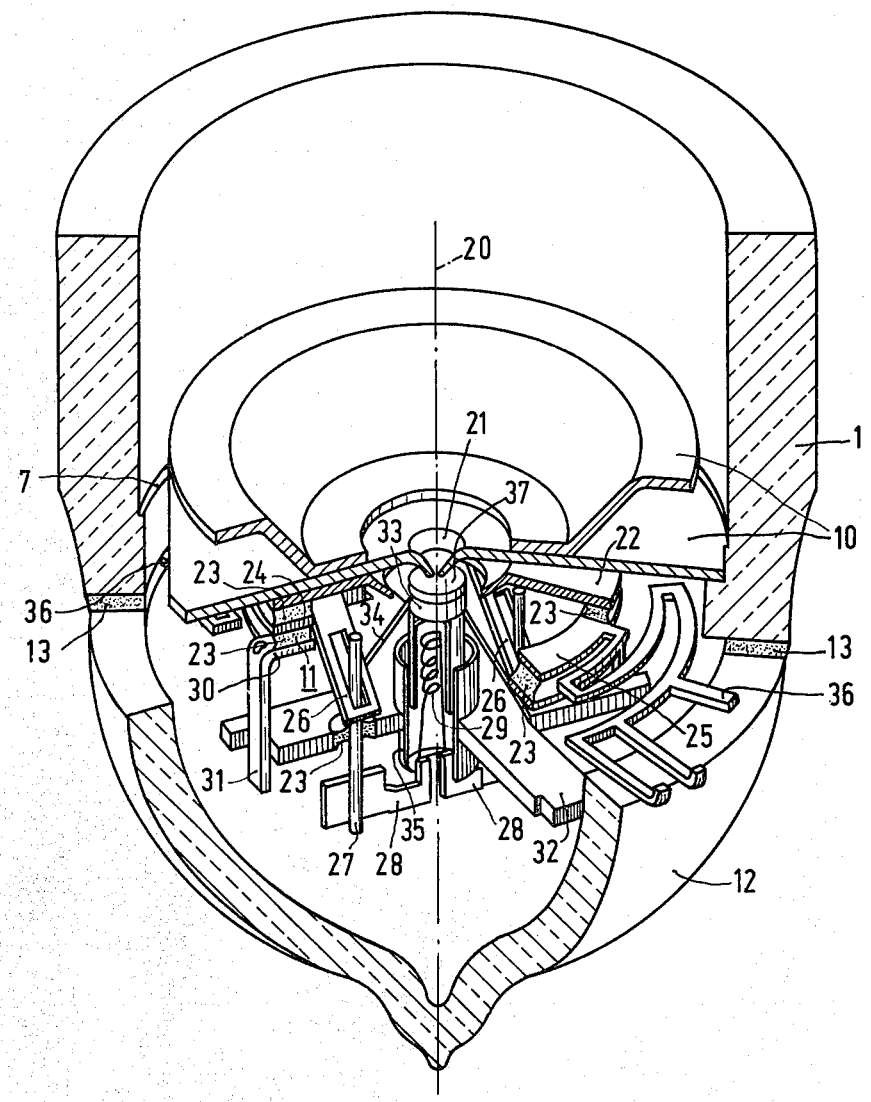
FIG. 2 is a sectional perspective view of a part of the cathode ray tube in FIG. 1.

Referring to FIGS. 2 and 3 the anode 10 which has a funnel-shaped aperture 21 is situated on the stepped surface 7 which forms a part of the inner wall of the envelope which is perpendicular to the axis 20 of the envelope. This anode is described in detail in Netherlands Patent Application No. 8002037 which has been incorporated in U.S. Pat. No. 4,376,907 and which is incorporated herein by reference. The cathode support 11, secured to the anode 10, comprises a first metal lamella 22 which makes electric contact with the anode. The second metal lamella 24 and the third metal lamella 25 situtated in one plane are secured to the first lamella by means of an electrically insulating sealing glass 23. These two lamellae constitute the connections for the cathode filament 29 via the contact springs 26, the rods 27 and the metal vanes 28. A fourth metal lamella 30 is secured to these two lamellae 24 and 25, again by means of an electrically insulating sealing glass 23. This fourth lamella comprises strips 31 extending parallel to the longitudinal axis 20 of the tube. A metal intermediate plate 32, on which the cathode shaft 33 comprising the emissive surface 37 is supported by means of bands 34, is connected to said strips. The metal intermediate plate comprises a central aperture in which a heat reflection screen 35 is provided coaxially around the cathode shaft 33. This cathode shaft provided in a heat reflection screen forms the subject matter of Netherlands Patent Application No. 8002343, which corresponds to U.S. Pat. No. 4,403,169, and which is to be incorporated herein by reference. The four lamellae, which together constitute the cathode support 11, include connection strips 36, extending to the outside of the tube via the sealing glass 13 which facilitate electric connections to the anode, the cathode and the cathode filament. The rods 27 pass through the intermediate plate 32 and are secured by means of a sealing glass 23.

It will be obvious that a construction in which the place of the fourth lamella 30 and the second and third lamellae 24 and 25 are interchanged also falls within the scope of the present invention.

Figure 4:
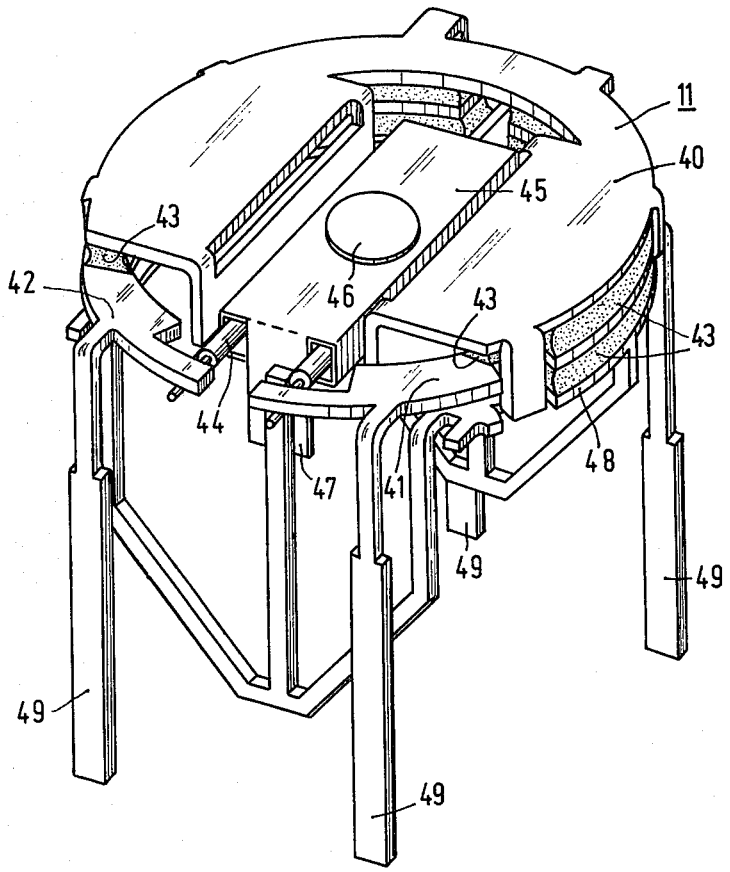
FIG. 4 is a perspective view of an alternative cathode assembly, and FIGS. 5*a, b* and *c* show parts of the bands as used in the method of manufacturing the cathode support as used in the construction shown in FIG. 2.

FIG. 4 is a perspective view of an alternative construction in accordance with the invention. The cathode support 11 consists of a first metal lamella 40 which is connected in the tube of FIG. 1 against the anode 10. Parallel to the first lamella 40 a second metal lamella 41 and a third metal lamella 42 are secured by means of an electrically insulating sealing glass 43. The ends of the cathode filament 44 are directly welded to 41 and 42, lamellae respectively. The cathode filament comprises an insulating coating and is provided in a box-shaped cathode shaft 45 which has an emissive surface 46. Cathode shaft 45 is connected to the fourth metal lamella 48 of the cathode support by means of lugs 47. The fourth lamella is secured parallel to the lamellae 41 and 42 by means of electrically insulating sealing glass 43. The connection strips 49 are passed through the tube wall and constitute the connections for the anode, the cathode and the cathode filament.

Figure 5A:
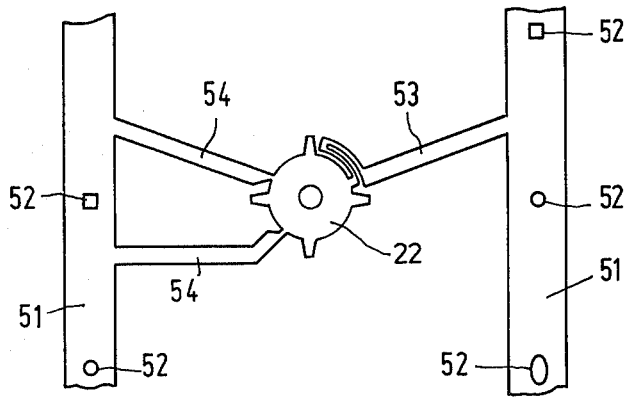
Figure 5B:
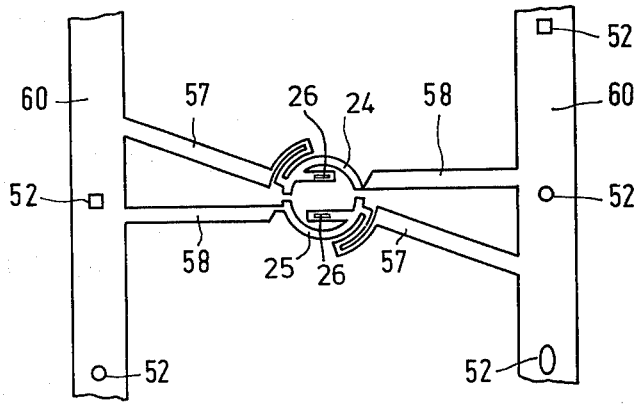
Figure 5C:
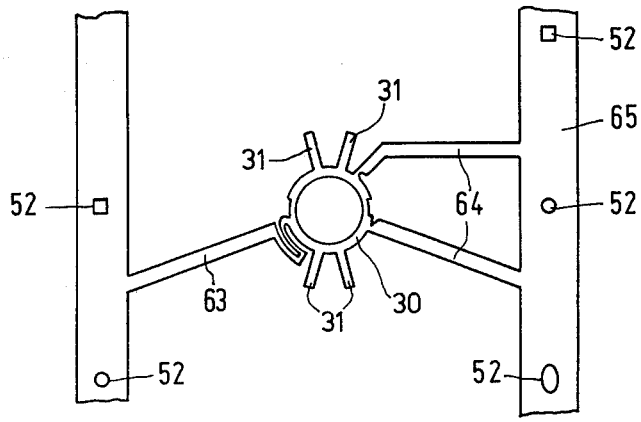

FIGS. 5*a*, 5*b* and 5*c* show parts of the bands as used in the method described, which parts are used in the manufacture of the construction shown in FIG. 2. These parts consists of Ni Cr Fe (47%, 5%, 48%) and have a thickness of 0.15 mm.

FIG. 5*a* shows the first metal lamella 22 which in the construction shown in FIG. 2 engages the anode 10. A large number of juxtaposed lamellae 22 (of which only one is shown) are interconnected by tapes 51, which have reference holes 52, by means of strips 53, 54, thus forming a band of lamellae. After assembly, the strips 54 are cut away. Part of strip 53 is left attached and constitutes the electric connection means 36 for the anode situated against the lamella.

FIG. 5*b* shows the second and third metal lamellae having reference numerals 24 and 25, respectively. After these lamellae are secured to lamella 22, the strips 57 are clipped such that part of each strip is left attached and serves as the means 36 for making the electric connections. The strips 58 are cut away. The lamellae 24, 25 also include the contact springs 26 as in the construction shown in FIG. 2. A large number of juxtaposed lamellae 24, 25 (only one of each is shown) are connected to tapes 60, which also has reference holes 52, by means of the strips 57, 58.

FIG. 5*c* shows the fourth metal lamella 30. The intermediate plate 32 (see FIG. 2) is connected to the strips 31 after bending-over. After assembly of the cathode support, the strips 64 are cut away and strip 63 is cut such that part remains attached to the lamella 30 and serves as the means 36 for making electric connection to the cathode shaft. A large number of juxtaposed metal lamellae 30 (only one of which is shown) are connected to tapes 65, having reference holes 52 by means of the strips 63, 64. By means of the reference holes 52 the lamellae 22, 24, 25 and 30 are accurately positioned relative to each other with the bands spaced apart at the desired distance from each other. Thus may be done, for example, by means of a stacking jig. Between the lamellae, rings or ring parts of a sealing glass (for example "soldering enamel type 7590" from Corning) are provided, after which the assembly thus formed is heated to the melting temperature of the sealing glass and the lamellae are secured together. The assembly strips 54, 58 and 64 are then clipped and the contact springs 26 as well as the connection strips 53, 57, 63 and the strips 31 are bent to the correct position.

It will be obvious that an analogous method may be used for the construction shown in FIG. 4. By using a cathode support which consists of a number of parallel lamellae which are secured together by means of a sealing glass so as to be accurately positioned, it is possible, to manufacture a television camera tube in a simple manner in automated mass production. Since the base may be omitted for assembling the electron gun and the tube comprises lateral lead-throughs, the tube is a few centimeters shorter than a comparable tube manufactured according to the prior-art. By making the anode plate-shaped and positioning it on a part of the wall of the envelope extending perpendicularly to the axis of the tube, a camera tube is obtained in which all electrodes are positioned accurately with respect to each other.

What is claimed is:

1. A cathode ray tube comprising an evacuated glass envelope containing a target and an electron gun for producing an electron beam directed at the target, said electron gun including an electrode and a cathode comprising a hollow cathode shaft and a filament extending into the shaft, said cathode being secured to the electrode by means of a cathode support comprising a plurality of spaced-apart metal lamellae secured to each other by means of electrical insulators, said lamellae including:

(a) a first lamella electrically-connected to the electrode;

(b) second and third lamellae secured to the first lamella, said second and third lamellae each spaced from the first lamella by substantially the same distance, each electrically-insulated from the other, and each electrically-connected to a respective lead of the cathode filament; and (c) a fourth lamella secured to and substantially equally spaced from the second and third lamellae, said fourth lamella being attached to the cathode shaft for supporting said shaft within the envelope.

2. A cathode ray tube as in claim 1 where the cathode shaft is supported within the envelope by means of an arrangement comprising:

(a) a plurality of metal strips extending from the fourth lamella;

(b) a metal intermediate plate attached to the strips, said plate being spaced from the fourth lamella; and (c) a plurality of metal strips each attached at one end to the intermediate plate and at the other to the cathode shaft.

3. A cathode ray tube as in claim 2 where the intermediate plate includes first and second openings and where the second and third lamellae are electrically-connected to the leads of the cathode filament by means of:

(a) first and second contact springs extending from the second and third lamellae, respectively;

(b) first and second metal rods extending through the first and second openings and making electrical contact with the first and second springs, respectively, said rods being secured within the openings by means of electrical insulators; and (c) first and second metal fins connected to the first and second metal rods, respectively, at ends of the rods extending from the openings on a side of the intermediate plate remote from the contact springs, said fins being connected to respective ones of the cathode filament leads.

4. A cathode ray tube as in claim 2 or 3 where the intermediate plate has a central opening and including a cylindrical heat reflection screen secured in said central opening, said cylindrical heat reflecting screen being coaxial with and extending around an outer surface of the cathode shaft.

5. A cathode ray tube as in claim 1, 2 or 3 where at least one lamella includes a metal strip extending through the envelope to facilitate external electrical connection to the lamella and to elements in the envelope with which said lamella is electrically-connected.

6. A method of manufacturing a cathode ray tube comprising an evacuated glass envelope containing a target and an electron gun for producing an electron beam directed at the target, said electron gun including an electrode and a cathode comprising a hollow cathode shaft and a filament extending into the shaft, said cathode being secured to the electrode by means of a cathode support comprising a plurality of spaced-apart metal lamellae secured to each other by means of electrical insulators, said method including:

(a) providing a plurality of bands each comprising a multiplicity of juxtaposed metal lamellae connected within the band by means of metal strips;

(b) positioning said metal bands relative to each other to form stacks of said lamellae in a predefined arrangement;

(c) securing the lamellae in each stack to each other by inserting sealing glass insulators between the lamellae and heating the glass to its melting temperature, thereby producing assembled stacks; and (d) cutting the strips to free the lamellae in the assembled stacks from their respective bands.

* * * * *